US007138577B2

(12) United States Patent
Takabayashi

(10) Patent No.: US 7,138,577 B2
(45) Date of Patent: Nov. 21, 2006

(54) STRINGED MUSICAL INSTRUMENT EQUIPPED WITH PICKUP EMBEDDED IN BRIDGE AND BRIDGE USED THEREIN

(75) Inventor: Yojiro Takabayashi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 155 days.

(21) Appl. No.: 10/857,222

(22) Filed: May 27, 2004

(65) Prior Publication Data

US 2004/0255762 A1 Dec. 23, 2004

(30) Foreign Application Priority Data

Jun. 19, 2003 (JP) ..... 2003-175404

(51) Int. Cl.
*G10H 3/18* (2006.01)

(52) U.S. Cl. ..... 84/731; 84/729; 84/730

(58) Field of Classification Search ..... 84/730, 84/731, 729, 736, 726
See application file for complete search history.

(56) References Cited

U.S. PATENT DOCUMENTS

| | | | | |
|---|---|---|---|---|
| 2,222,057 | A * | 11/1940 | Benioff | 84/729 |
| 3,291,887 | A | 12/1966 | Carman et al. | |
| 3,453,920 | A * | 7/1969 | Scherer | 84/731 |
| 4,860,625 | A * | 8/1989 | Mathews | 84/731 |
| 4,867,027 | A * | 9/1989 | Barbera | 84/731 |
| 5,911,171 | A | 6/1999 | Wong | |
| 5,945,622 | A * | 8/1999 | Yamada | 84/731 |
| 6,018,120 | A * | 1/2000 | Steinberger | 84/731 |
| 6,255,565 | B1 | 7/2001 | Tamura | |
| 6,515,214 | B1 * | 2/2003 | Takabayashi | 84/731 |
| 6,791,023 | B1 | 9/2004 | Nakaya | |
| 2002/0157523 | A1 * | 10/2002 | Takabayashi | 84/731 |

FOREIGN PATENT DOCUMENTS

| | | |
|---|---|---|
| JP | SHO 53-26132 | 3/1978 |
| JP | SHO 53-109431 | 9/1978 |
| JP | SHO 56-22598 | 2/1981 |
| JP | 58-7197 | 7/1981 |
| JP | HEI 3-20398 | 2/1991 |
| JP | 3-85600 | 4/1991 |
| JP | HEI 5-94896 | 12/1993 |
| JP | 2000-148148 | 5/2000 |
| JP | 2000-250559 | 9/2000 |

* cited by examiner

*Primary Examiner*—Lincoln Donovan
*Assistant Examiner*—Christina Russell
(74) *Attorney, Agent, or Firm*—Morrison & Foerster LLP

(57) ABSTRACT

An electric acoustic violin is a combination of an acoustic violin and an electric system, and the electric system includes a pickup unit for converting the vibrations of the strings to an electric signal; and a hollow space is formed in the bridge for receiving the pickup unit so that the vibrations are transferred from the strings through the bridge to the pickup unit, whereby the pickup unit faithfully converts the vibrations to the electric signal without any influence of the tension exerted on the bridge by the strings.

27 Claims, 9 Drawing Sheets

STRINGED MUSICAL INSTRUMENT EQUIPPED WITH PICKUP EMBEDDED IN BRIDGE AND BRIDGE USED THEREIN

FIELD OF THE INVENTION

This invention relates to a stringed musical instrument and, more particularly, to a stringed musical instrument equipped with transducers and a bridge incorporated therein for propagating vibrations from strings to the transducers.

DESCRIPTION OF THE RELATED ART

The musical instrument is broken down into two categories, i.e., acoustic musical instruments and electric/electronic musical instruments. The electric/electronic musical instruments are usually assisted by amplifiers to generate the electric/electronic sound, and, accordingly, the dynamic range is wide. On the other hand, players generate the acoustic sound through the vibrations of the acoustic musical instruments so that the dynamic range is relatively narrow. While a player is performing a piece of music on an acoustic musical instrument in ensemble with other sorts of acoustic musical instruments, the players do not feel it difficult to balance the loudness among the parts of the piece of music. However, the player is assumed to perform a piece of music on the acoustic musical instrument in ensemble with an electric/electronic musical instrument in a concert hall. The acoustic tones are drowned in the loud electric/electronic tones in so far as the acoustic musical instrument is not assisted by a microphone system.

A compromise has been proposed. The compromise is fabricated on the basis of the acoustic musical instrument, and is an acoustic musical instrument equipped with a transducer. The vibrations of the acoustic musical instrument are converted to an electric signal through the transducer. The electric signal is supplied through amplifiers to loud speakers as similar to the electric/electronic musical instrument, and the tones are radiated from the loud speakers at a large loudness. The players can generate the loud tones through the compromise, and, for this reason, the compromise is preferable to the acoustic musical instrument for the ensemble with the electric/electronic musical instrument.

The compromise is hereinafter referred to as "electric acoustic musical instrument". Typical examples of the electric acoustic stringed musical instrument are disclosed in U.S. Pat. Nos. 5,945,622 and 6,018,120. The electric acoustic stringed musical instrument disclosed in U.S. Pat. No. 5,945,622 is hereinafter referred to as the first prior art electric acoustic stringed musical instrument, and the other is referred to as the second prior art electric acoustic stringed musical instrument.

The first prior art electric acoustic stringed musical instrument has a contour like the acoustic violin, and comprises an acoustic violin and a piezoelectric pickup. The acoustic violin includes a body, a fingerboard, a peg box, a string holder, strings and a bridge. The fingerboard projects from one end of the body, and the peg box is secured to the leading edge of the fingerboard. The string holder is secured to the other end portion of the body, and strings are stretched between the pegs and the string holder. The bridge is upright on the body, and gives the tension to the strings. The piezoelectric pickup is inserted between the top surface of the body and the bridge. While a player is bowing, the bow gives rise to vibrations of the strings, and the vibrations are propagated from the strings through the bridge to the piezoelectric pickup. The piezoelectric pickup converts the vibrations to the electric signal, and the electric signal is supplied through a filter to amplifiers.

The bridge is broken down into a body portion and a bifurcated portion, i.e., a pair of legs. The body portion has an upper arc surface, and the legs downwardly project from the lower arc surface of the body portion to the body. Notches are formed in the upper region of the body portion, and open out on the arc surface. The strings are received in the notches, respectively. Neither hollow space nor aperture is formed in the remaining body portion. The two legs are laterally spaced from each other. Any slit is not formed in the legs and the boundary between the body portion and the legs.

The piezoelectric pickup is inserted between the top surface of the body and the legs. In other words, the bridge stands on the piezoelectric pickup. For this reason, the piezoelectric pickup produces an electric signal representative of the vibrations, which have been propagated from the vibrating strings through the bridge to the piezoelectric pickup.

The second prior art electric acoustic stringed musical instrument also has a contour like a violin, and comprises an acoustic violin and a piezoelectric pickup. The acoustic violin is similar in structure to the acoustic violin of the first prior art electric acoustic stringed musical instrument, and the bridge stands on the top surface of the body. The piezoelectric pickup is provided between one of the feet of the bridge and the top surface of the body.

As described hereinbefore, the vibration sensors are provided between the bridge and the body in those prior art electric acoustic stringed musical instruments. However, a problem is encountered in the prior art electric acoustic stringed musical instruments in the fidelity of the piezoelectric pickup. In other words, the piezoelectric pickup can not simulate the vibrations of the acoustic violin due to the poor fidelity. For example, when the player delicately changes the bowing, the piezoelectric pickup can not transfer the delicate nuance to the electric signal. This results in frustration of the player.

SUMMARY OF THE INVENTION

It is therefore an important object of the present invention to provide an electric acoustic stringed musical instrument, the fidelity of which is enhanced.

It is another important object of the present invention to provide a bridge, which allows a pickup to exhibit good fidelity.

The present inventor contemplated the problem inherent in the prior art electric acoustic stringed musical instruments. The present inventor noticed that the pickup awkwardly behaved between the bridge and the body. The reason why the pickup awkwardly behaved was that the pickup was excessively suppressed between the pickup and the body. The present inventor concluded that the pickup was to be released from the excessive suppression.

To accomplish the object, the present invention proposes to embed a pick-up in a bridge.

In accordance with one aspect of the present invention, there is provided an electric acoustic stringed musical instrument comprising an acoustic stringed musical instrument including a body having an upper surface, a neck projecting from one end of the body, at least one string stretched between a leading end of the neck and the other end of the body and a bridge provided between the upper surface of the body and the at least one string so as to give tension to the at least one string, deformable in the presence of vibrations transmitted from the at least one string and having an inner surface defining at least one hollow space, and an electric system including a pickup unit received in the at least one hollow space and applied with force due to the vibrations of the at least one string through the inner surface for producing a signal representative of the vibrations and an output terminal electrically connected to the pickup unit for outputting the signal.

In accordance with another aspect of the present invention, there is provided a bridge provided between a body and at least one string both incorporated in an electric acoustic stringed musical instrument for imparting tension to the at least one string, and the bridge comprises a plate member deformable in the presence of vibrations transmitted from the at least one string and having an inner surface defining at least one hollow space where a pickup unit is received in such a manner that the force is exerted on the pickup unit by the inner surface due to the vibrations.

BRIEF DESCRIPTION OF THE DRAWINGS

The features and advantages of the electric acoustic stringed musical instrument and the bridge will be more clearly understood from the following description taken in conjunction with the accompanying drawings, in which.

DESCRIPTION OF THE PREFERRED EMBODIMENTS

Figure 1:
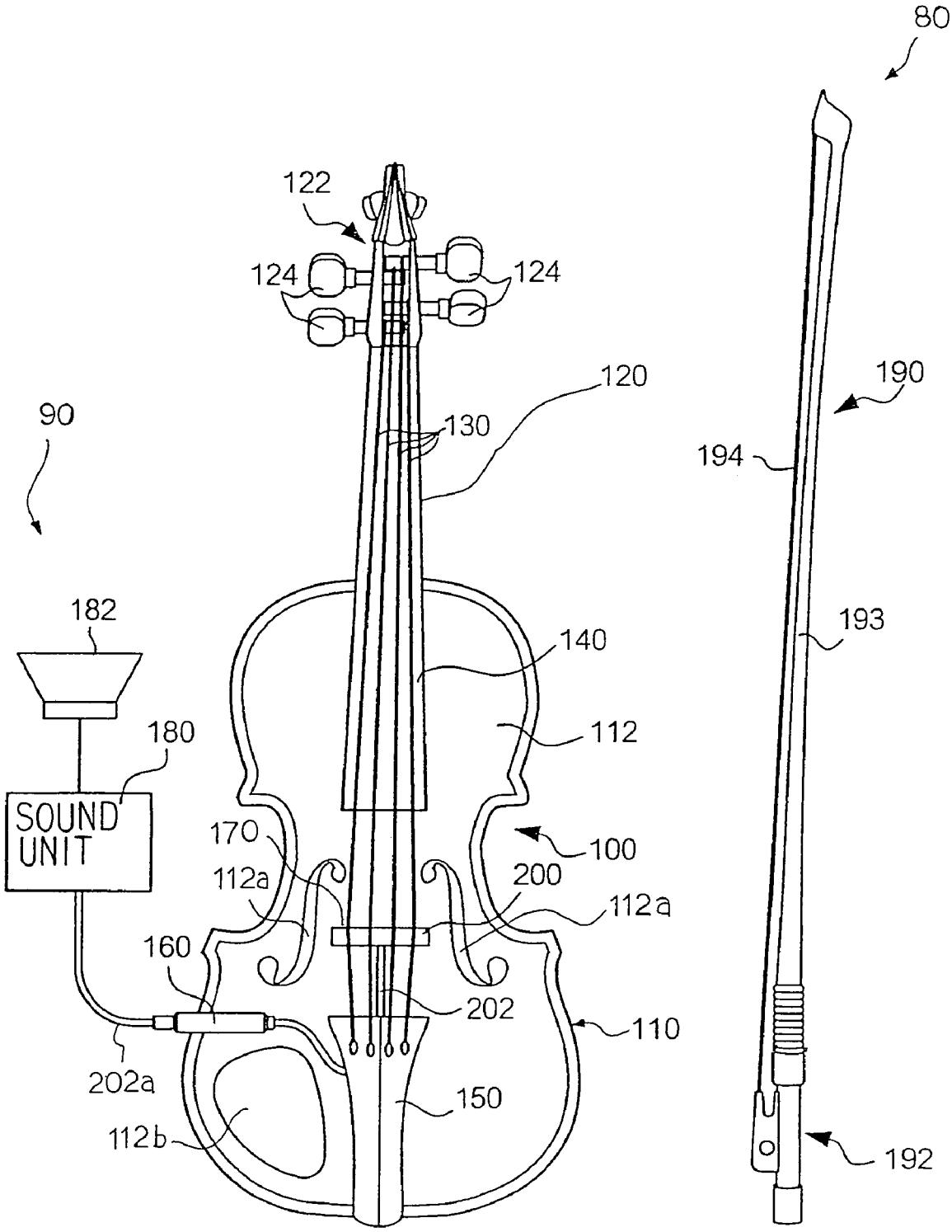
FIG. 1 is a plane view showing the structure of an electric acoustic stringed musical instrument according to the present invention.

An electric acoustic stringed musical instrument largely comprises an acoustic stringed musical instrument and an electric system. The acoustic stringed musical instrument includes a body, a neck, a string or strings and a bridge. The body may be formed with a sound chamber for resonance of the acoustic tones, and the neck projects from the body. The string or strings are stretched between the leading end of the neck and the body, and the bridge gives tension to the string or strings.

On the other hand, the electric system includes at least a pickup unit and a connector serving as output terminals. Another electric system may further include a sound system and a tone radiator such as, for example, loud speaker and/or a headphone. The pickup unit converts the vibrations to an electric signal, and the electric signal is output from the output terminals to the sound system. The sound system drives the tone radiator with the electric system for radiating the electric tones. If the pickup unit converts the vibrations to an optical signal, the optical signal is finally converted to an electric signal, and the sound unit drives the tone radiator with the electric signal.

The bridge is formed with a hollow space. An inner surface defines the hollow space, and the pickup unit is received in the hollow space. In case where the pickup unit is implemented by plural transducers, the hollow space is divided into plural hollow sub-spaces, and the plural sub-spaces are respectively assigned to the plural transducers. Piezoelectric transducers are available for the pickup unit. In order to prevent the piezoelectric elements from excessive restraint, the hollow space is to be wide enough to loosely receive the piezoelectric elements. However, the force is to be transmitted to the piezoelectric elements. The gap between the inner surface and the piezoelectric elements may be filled with filler. Otherwise, the hollow space is partially narrowed so that the inner surface directly exerts the force on the piezoelectric elements. Filler, which exhibits the plasticity, is preferable to filler exhibiting the elasticity or resiliency. This is because of the fact that the filler with the plasticity is not causative of noise ridden on the electric signal. The filler with the plasticity neither accumulates the force in the form of elastic strain energy, nor releases the elastic strain energy. Any stress is not exerted on the piezoelectric elements so that the electric signal is free from the noise, which is causative of echo.

A bimorph piezoelectric transducer is desirable for the pickup unit, because the electric signal swings the potential level wider than that produced from the mono-morph piezoelectric transducer. If more than one bimorph piezoelectric transducer is connected in series or in parallel in such a manner that the electric charge are not canceled, the electric signal swings the potential level more closely to the vibrations of the string than that of the single bimorph piezoelectric transducer.

The primary advantage of the pickup unit embedded in the bridge is the good fidelity. Although the string or strings exert the downward component force of the tension on the bridge, the pickup is free from the downward component force. This means that the pickup unit converts the force exerted thereon due to the vibrations to the electric signal. Thus, the pickup unit embedded in the bridge enhances the fidelity of the electric signal.

Another advantage of the pickup unit embedded in the bridge is that the player can easily adjust the height of the strings to his or her own value, because the pickup unit does not add the thickness thereof to the height of the bridge. In other words, the player has been familiar with the bridge so that he or she can easily adjust the string or strings to his or her optimum height.

Description is hereinafter made on electric acoustic stringed musical instruments and modifications thereof embodying the present invention with reference to the drawings. However, the aspect ratio of the electric acoustic stringed musical instruments/component parts illustrated in figures and the scale thereof may be different from those of the commercial products. In the following description, term "longitudinal" is indicative of a direction in which strings are stretched, and term "lateral" is indicative of a direction crossing the longitudinal direction at right angle. Term "vertical" is indicative of a direction normal with the virtual plane defined by the longitudinal direction and the lateral direction.

First Embodiment

Electric Acoustic Musical Instrument

Referring first to FIG. 1 of the drawings, an electric acoustic stringed musical instrument embodying the present invention largely comprises an acoustic stringed musical instrument 80 and an electric system 90. The electric system 90 is partially provided in the acoustic stringed musical instrument 80. However, the remaining electric system 90 is physically separated from the acoustic stringed musical instrument 80. A player gives rise to vibrations of the acoustic stringed musical instrument 80, and the electric system 90 electrically produces tones, i.e., electric tones on the basis of the vibrations of the acoustic stringed musical instrument 80.

In this instance, the acoustic stringed musical instrument 80 consists of a violin 100 and a bow 190, and a part 170 of the electric system 90 is embedded in the violin 100. The player gives rise to the vibrations of the violin 100 with the bow 190, and the vibrations are propagated to the part 170 of the electric system 170. The electric system 90 produces an electric signal representative of the vibrations, and converts the electric signal to the electric tones.

Acoustic Violin

The acoustic violin 100 includes a body 110, a neck 120, a peg box 122, strings 130, a fingerboard 140, a string holder 150 and a bridge 200. A soundboard 112, a bottom board (not shown) and sideboards (not shown) form in combination the body 110, and a sound chamber is defined in the body 110. The soundboard 112 is constricted, and the bottom board has the contour same as that of the soundboard 112. The soundboard 112 is spaced from the bottom board, and the sideboards extend along the peripheries of the sound board/bottom board. The sideboards are secured to the peripheries of the soundboard/bottom board so that the sound chamber is formed in the body 110. Sound holes 112*a* are formed in the soundboard 112 so that the sound chamber is open to the ambience through the sound holes 112*a*. A chin rest 112*b* is further formed on the soundboard 112, and a player presses his or her chin to the chin rest 112*b* for holding the acoustic violin 100 between the chin and the upper thorax.

The neck 120 projects from one end portion of the body 110 in the longitudinal direction, and the peg box 122 is provided at the leading end of the neck 120. Four pegs 124 are turnably supported by the peg box 122, and the axes of rotation laterally extend. The fingerboard 140 is adhered to the neck 120, and extends in the longitudinal direction. The string holder 150 is connected to the other end portion of the body 110, and the bridge 200 is upright on the soundboard 112 between the fingerboard 140 and the string holder 150. The four strings 130 extend over the bridge 200, and are stretched between the pegs 124 and the string holder 150.

A handle 192, a stick 193 and hair 194 are assembled into the bow 190. The handle 192 is secured to one end of the stick 193, and the hair 194 is stretched between the other end of the stick 193 and the handle 192. The player holds the handle 192 with the right hand, and laterally moves the hair 194 on the strings 130 so as to give rise to the vibrations.

While a player is bowing, the strings 130 vibrate, and the vibrations are propagated from the strings 130 through the bridge 200 to the body 110 so that relatively loud acoustic tones are radiated from the body 110 through the resonance in the sound chamber. When the player presses the strings 130 to the fingerboard 140, the vibrating strings 130 are shortened, and the acoustic tones are sharp pitched. Thus, the acoustic violin 100 and bow 190 are similar to a standard violin and its bow.

The electric system 90 includes a connector 160, a pickup unit 170, a sound unit 180, a sound radiator 182 and conductive leads 202 (see FIGS. 2, 3)/202*a*. As will be herein later described in detail, the pickup unit 170 is embedded in the bridge 200. The pickup unit 170 is connected through the conductive lead 202 to the connector 160, and the other conductive lead 202*a* is connected to and disconnected from the connector 160. The conductive lead 202*a* is connected at the other end thereof to the sound unit 180 so that the electric signal is supplied from the pickup unit 170 through the conductive leads 202/202*a* to the sound unit 180. A control amplifier and a power amplifier are incorporated in the sound unit 180 together with effectors. The electric signal is equalized and amplified in the sound unit 180, and the effectors are used for reverberation, echo and so forth when the player requests them. In this instance, the sound radiator 182 is implemented by loud speakers, and converts the electric signal to the electric tones.

When a player wishes to play a piece of music on the electric acoustic stringed musical instrument, he or she connects the conductive lead 202*a* to the conductive lead 202 through the connector 160, and appropriately tunes the sound unit 180. When the player gets ready to play, he or she keeps the acoustic violin 100 stable between the chin and the upper thorax, and starts to bow the strings 130 with the hair 194. While the player is bowing, he or she slides the fingers on the fingerboard 140 for changing the length of the vibrating strings 130 along the music passage. The strings 130 vibrate, and the vibrations are propagated from the strings 130 through the bridge 200 to the pickup unit 170. The pickup unit 170 converts the vibrations to the electric signal, and the electric signal is supplied from the pickup unit 170 through the conductive leads 202/202*a* to the sound unit 180. The electric signal is equalized in frequency characteristics, and is amplified. The electric signal thus equalized and amplified in the sound unit 180 is supplied to the tone radiator 182, and is converted to the electric tones.

Figure 2:
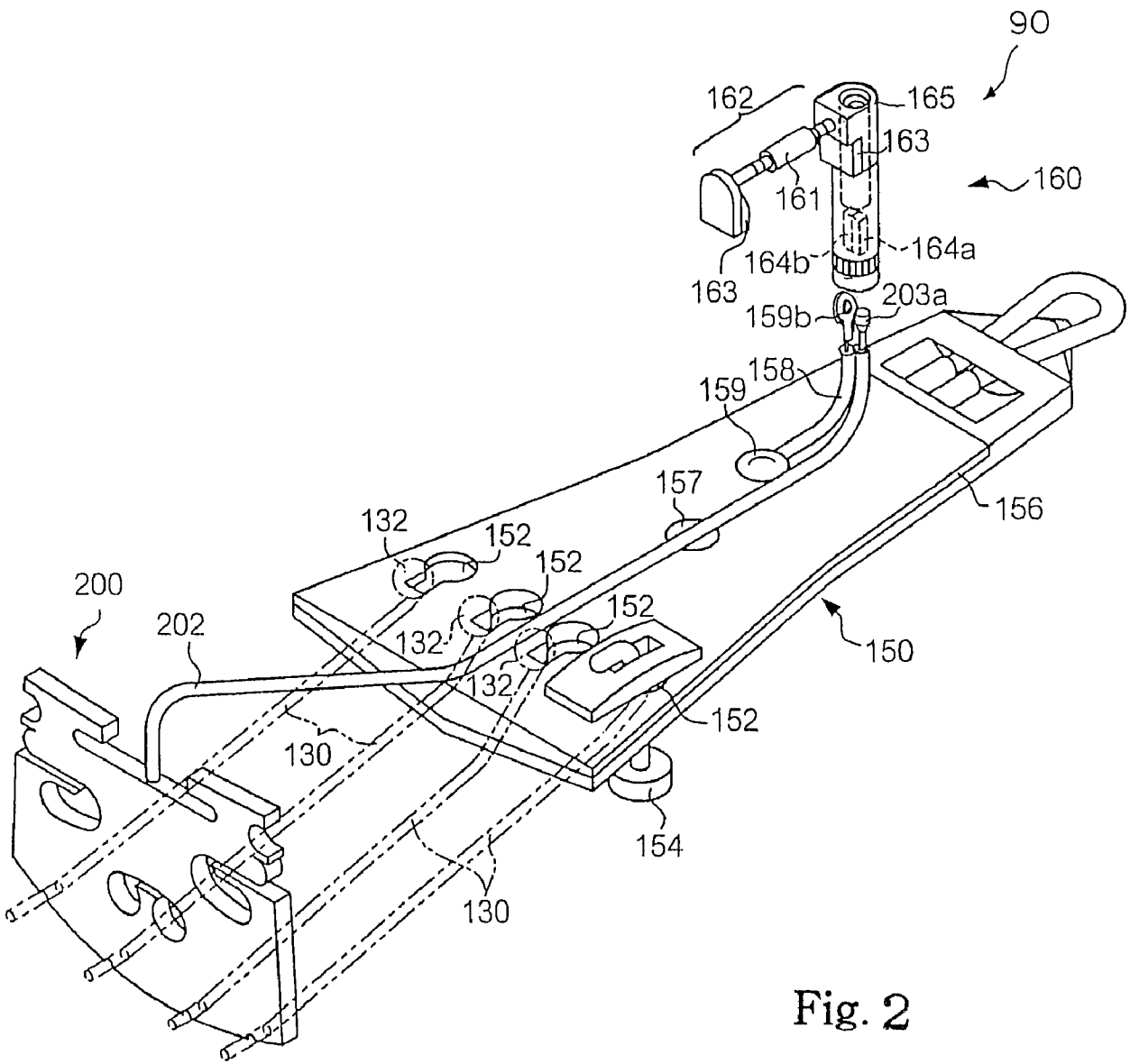
FIG. 2 is a perspective view showing the configuration of a bridge and a string holder incorporated in the electric acoustic stringed musical instrument.

Turning to FIG. 2 of the drawings, the string holder 150 and bridge 200 are illustrated in detail. The string holder 150 and bridge 200 are turned over so that the reverse surface of the string holder 150 is seen in FIG. 2. A conductive metal foil 156 is adhered to the reverse surface of the string holder 150, and the lamination of string holder 150 and conductive metal foil 156 is formed with four string holes 152, which are assigned to the four strings 130, respectively. In this instance, the conductive metal foil 156 is made of copper. However, another sort of conductive metal or alloy such as, for example, aluminum or aluminum alloy may be available for the conductive metal foil 156. The string holes 152 have a contour like a keyhole, and a conductive adjuster 154 is prepared for one of the string holes 152. The strings 130 have respective conductive anchors 132. The three strings 130 are connected to the string holder 150 by means of the anchors 132, which are directly held in contact with the peripheries of the conductive metal foil 156 defining the string holes 152. The remaining string 130 is connected to the conductive metal foil 156 by means of the conductive adjuster 154. Thus, the strings 130 are electrically connected through the conductive anchors 132 and conductive adjuster 154 to the conductive metal foil 156. The conductive metal foil 156 offers the ground level to the strings 130. Although a player exerts tensile force through the strings 130 to the lamination of string holder 150 and conductive metal foil 156, the string holder 150 is tough enough to withstand the tensile force.

The bridge 200 is upright on the soundboard 112, and upwardly spaces the strings 130 from the soundboard 112. The bridge 200 is operative to propagate the vibrations from the strings 130 to both of the soundboard 112 and the electric system 90. The first function, i.e., propagating the vibrations from the strings 130 to the soundboard 112, is similar to the bridge incorporated in a standard acoustic violin. While a player is bowing, the bridge 200 propagates the vibrations from the vibrating strings 130 to the soundboard 112, and gives rise to the vibrations of the body 110. The vibrations are enlarged through the resonance in the sound chamber, and loud acoustic tones are radiated from the body 110. The other function will be hereinlater described in detail in conjunction with the electric system 90.

Figure 4:
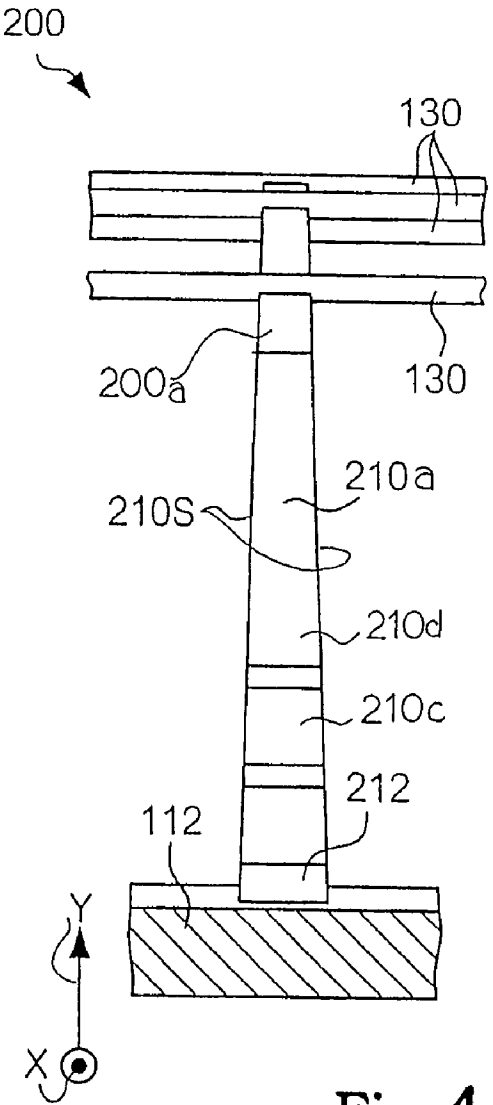
FIG. 4 is a side view showing the bridge.
Figure 3:
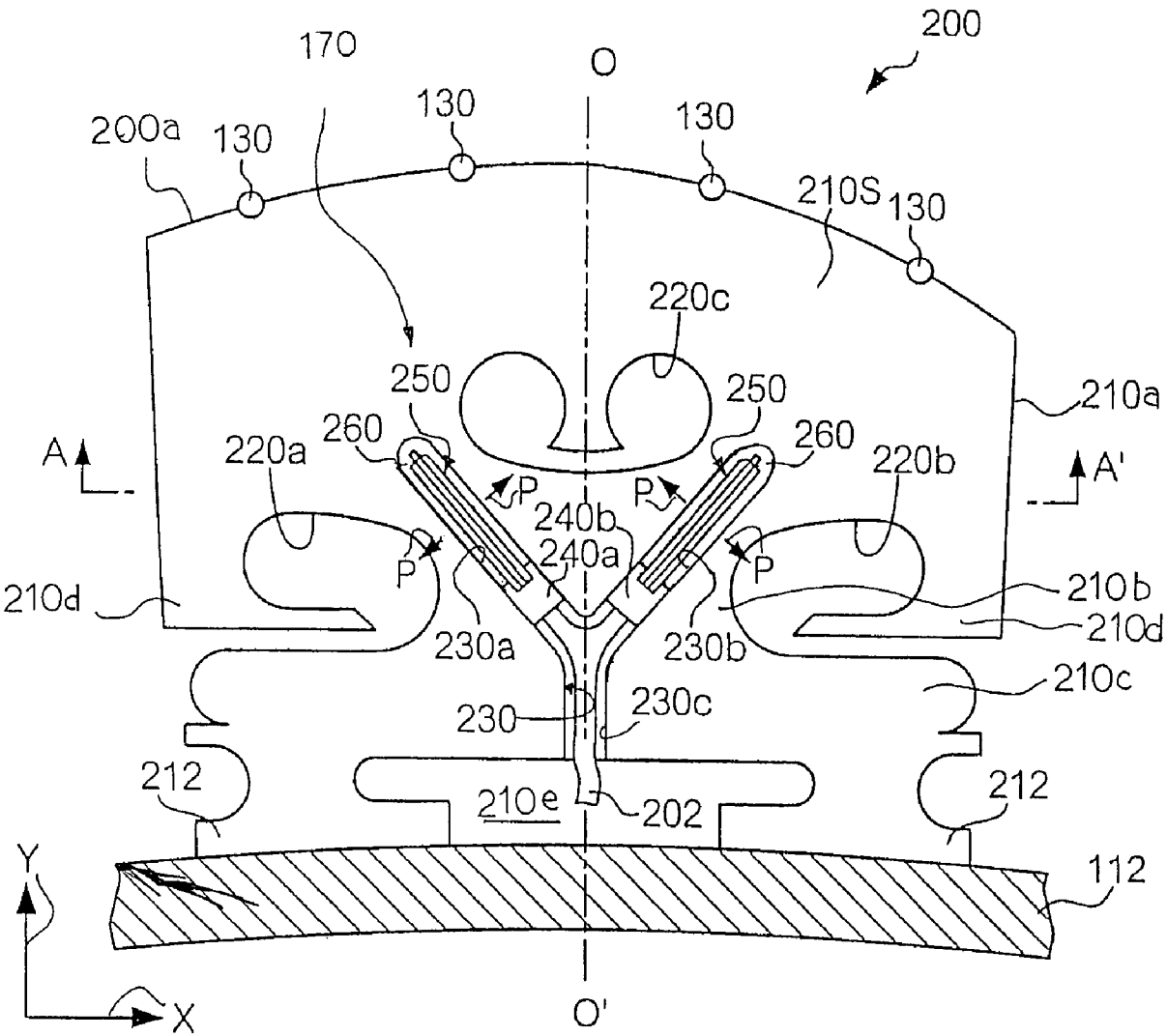
FIG. 3 is a front view showing the configuration of the bridge.

Turning to FIGS. 3 and 4, the bridge 200 stands on the soundboard 112. The bridge 200 is substantially vertical to the upper surface of the soundboard 112, and has major surfaces 210S, which extend in parallel to the lateral direction "X ". In FIGS. 3 and 4, the lateral direction is indicated by an arrow "X", and the vertical direction is labeled with "Y ". The bridge 200 is made of wood, such as, for example, maple as similar to the bridge of a standard acoustic violin. The bridge 200 is a thin plate, and has an arc top surface 200*a*. Four notches are formed, and come out on the arc top surface 200*a*. The four strings 130 are received in the notches. Pieces of wood are cut out from the thin wood plate for forming three hollow spaces 220*a*, 220*b*, and 220*c*, and the hollow spaces 220*a* and 220*b* divide the bridge 200 into three portions, i.e., an arch portion 210*a*, a constricted portion 210*b* and a bifurcated portion 210*c*. The left hollow space 220*a* and right hollow space 220*b* make the bridge 200 constricted, and the bridge 200 is bifurcated downwardly from the constricted portion 210*b*. The bifurcated portion 210*c* has right and left feet 212, which are on the soundboard 112 as shown. Thus, the vibrations of the strings 130 are input to the arc surface 200*a*, propagated through the arch, constricted and bifurcated portions 210*a*, 210*b* and 210*c*, and are output from the feet 212 to the soundboard 112.

The left hollow space 220*a* and right hollow space 220*b* have a contour like an inlet, and make the constricted portion 210*c* spaced from slant-arms 210*d* of the arch section 210*a*. The center hollow space 220*c* is formed in the arch portion 210*a*, and is substantially symmetrical with respect to the center-line O–O' of the bridge 200. The centerline O–O' the soundboard 112, and equally divides the width of the bridge 200. The bifurcated portion 210*c* defines a gap 210*e* between the right foot 212 and the left foot 212. A groove 230 is formed in the bridge 200. The groove 230 has a trunk portion 230*c* and branch portions 230*a*/230*b*. The trunk portion 230*c* is open at the lower end thereof to the gap 210*e*, and upwardly extends through the bifurcated portion 210*c*. The centerline of the trunk portion 230*c* is substantially coincident with the centerline O–O' of the bridge 200. The trunk portion 230*c* branches to the branch portions 230*a* and 230*b* at the boundary between the bifurcated portion 210*c* and the constricted portion 210*b*, and the branch portions 230*a* and 230*b* obliquely upwardly project through the constricted portion 210*b* into the arch portion 210*a*. The branch portions 230*a* and 230*b* extend in the arch portion 210*a* between the left hollow space 220*a* and the center hollow space 220*c* and between the right hollow space 220*b* and the center hollow space 220*c*, and are symmetrically arranged with respect to the trunk portion 230*c* and the centerline O–O'.

Figure 5:
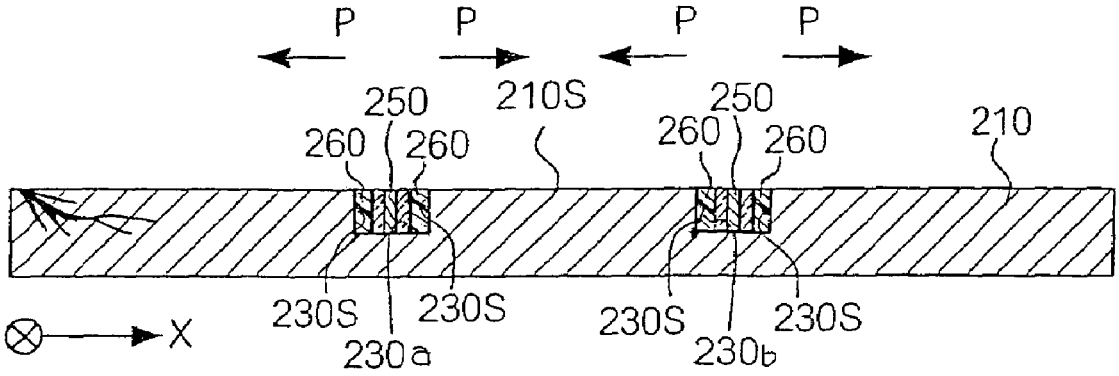
FIG. 5 is a cross sectional view taken along line A–A' of FIG. 3 and showing bimorph piezoelectric transducers embedded in the bridge.

The branch portions 230*a* and 230*b* (see FIG. 3) are assigned to a pickup device 170, which form a part of the electric system 90. In this instance, the pickup device 170 is implemented by a pair of bimorph piezoelectric transducers 250, and the bimorph piezoelectric transducers 250 are respectively received in the branch portions 230*a* and 230*b*. The bimorph piezoelectric transducers 250 have respective sensor holders 240*a*/240*b*, which are, by way of example, made of synthetic resin, and the holders 240*a* and 240*b* are adhered to the constricted portions 210*b* in the vicinity of the bifurcation of the groove 230. The bimorph piezoelectric transducers 250 have a thickness less than the width of the branch portions 230*a* and 230*b* so that the piezoelectric elements extend in the branch portions 230*a* and 230*b* without any physical contact to the inner surfaces 230*s* (see FIG. 5). In other words, the piezoelectric elements are spaced from the inner surfaces 230*s*, which define the branch portions 230*a*/230*b*, and the gap between the piezoelectric elements and the inner surfaces is filled with filler 260. The filler 260 forms part of the bridge 200. For this reason, the vibrations are propagated through the arch/constricted portions 210*a*/210*b* to the filler 260, which in turn propagates the vibrations to the bimorph piezoelectric transducers 250.

The filler 260 is made of substance in which no strain energy or a negligible amount of strain energy is accumulated during the deformation of the bridge 200 due to the vibrating strings 130. In other words, the filler 260 does not exhibit the elasticity. For this reason, although the bridge 200 repeatedly changes the direction of the force exerted on the filler 260, the filler 260 faithfully follows the bridge 200 so that the filler 260 correctly propagates the deformation of the bridge 200 to the piezoelectric elements 252*a*/252*b* (see FIGS. 8 and 9). In this instance, the filler 260 is made of oil clay, i.e., mixture of oil and clay. The vibrations, which are propagated from the strings 130 to the bridge 200, cause the oil clay to be plastically deformed. For this reason, the vibrations are transferred to the piezoelectric elements 252*a*/252*b* without serious distortion, and the piezoelectric elements 252*a*/252*b* are free from the after effect due to the elastic strain energy.

In the following description, term "plastic material" means that the material exhibits the plastic deformation in the presence of the force transferred from the strings 130. On the other hand, term "elastic material" means that the material exhibits the elastic deformation in the presence of the force transferred from the strings 130. Term "resilient material" also means that the material exhibits the resiliency in the presence of the force transferred from the strings 130. The oil clay is an example of the plastic material, and rubber is an example of the resilient material.

The present inventor evaluated the plastic material and elastic/resilient material. The present inventor prepared samples of the bridge 200 and bimorph piezoelectric transducers 250. The bimorph piezoelectric transducers were inserted into the bifurcated groove 230 of each sample of the bridge 200. The gaps of one sample were filled with the oil clay, i.e., plastic material and the gaps of another sample were filled with the rubber, i.e., resilient material. The samples of the bridge 200 were selectively attached to the violin 100 (see FIG. 1), and a player bowed a music passage on the strings 130. The pickup unit 170 outputted the electric signal, and the waveforms of the electric signal were analyzed from the viewpoint of the fidelity.

The present inventor noticed that a substantial amount of echo component was ridden on the electric signal produced from the vibrations transferred through the rubber. On the other hand, only a negligible amount of echo component was ridden on the electric signal produced from the vibrations transferred through the oil clay. The echo component was derived from the resiliency of the rubber. When the force was exerted on the rubber, the force was partially accumulated in the rubber as the elastic strain energy. The force was changed in direction, then the elastic strain energy was released form the rubber. The elastic strain energy had the influence on the piezoelectric elements 252*a*/252*b*, and was causative of the echo component. The present inventor concluded that the plastic material was preferable to the elastic/resilient material.

Though not shown in the drawings, a protective plate is attached onto the major surface 210*s* of the bridge 200 so that the bimorph piezoelectric transducers 250 and filler 260 are sandwiched between the bridge 200 and the protective plate, and are prevented from undesirable damages.

The pickup unit 170 embedded in the bridge 200 is preferable to the prior art pickup unit provided between the body and the legs of the bridge. First, although the strings 130, which are stretched between the pegs 124 and the string holder 150, push the bridge 200 downwardly, the downward component force is not exerted on the piezoelectric elements 252*a*/252*b*. For this reason, the pickup unit 170 exactly converts the vibrations to the electric signal.

Another advantage of the pickup unit 170 embedded in the bridge 200 is that the user can assemble the bridge 200 into and disassembled it from the acoustic violin 100 in a similar manner to those of standard acoustic violins. The pickup unit 170 does not change the height of the bridge on the soundboard 112. The can tune the strings 130 as usual.

Electric System

As shown in FIG. 1, the electric system 90 includes the pickup unit 170, which is implemented by the pair of bimorph piezoelectric transducers 250 (see FIGS. 3 and 4), conductive leads 202/202*a*, connector 160, sound unit 180 and tone radiator 182 as described hereinbefore. Those system components are hereinafter described in detail.

The bimorph piezoelectric transducers 250 are a transducer of the type converting mechanical energy to electric energy. Force is assumed to be exerted on the piezoelectric element. The force gives rise to strain in the piezoelectric element. Then, the polarization occurs in the piezoelectric element, and electric charge takes place. The amount of electric charge is proportional to the strain and, accordingly, the force exerted on the piezoelectric elements. Thus, the force is converted to the electric current. In this instance, the force is exerted on the piezoelectric elements from the inner surfaces 230*s*, which define the branch portions 230*a*/230*b*, through the filler 260.

Figure 6:
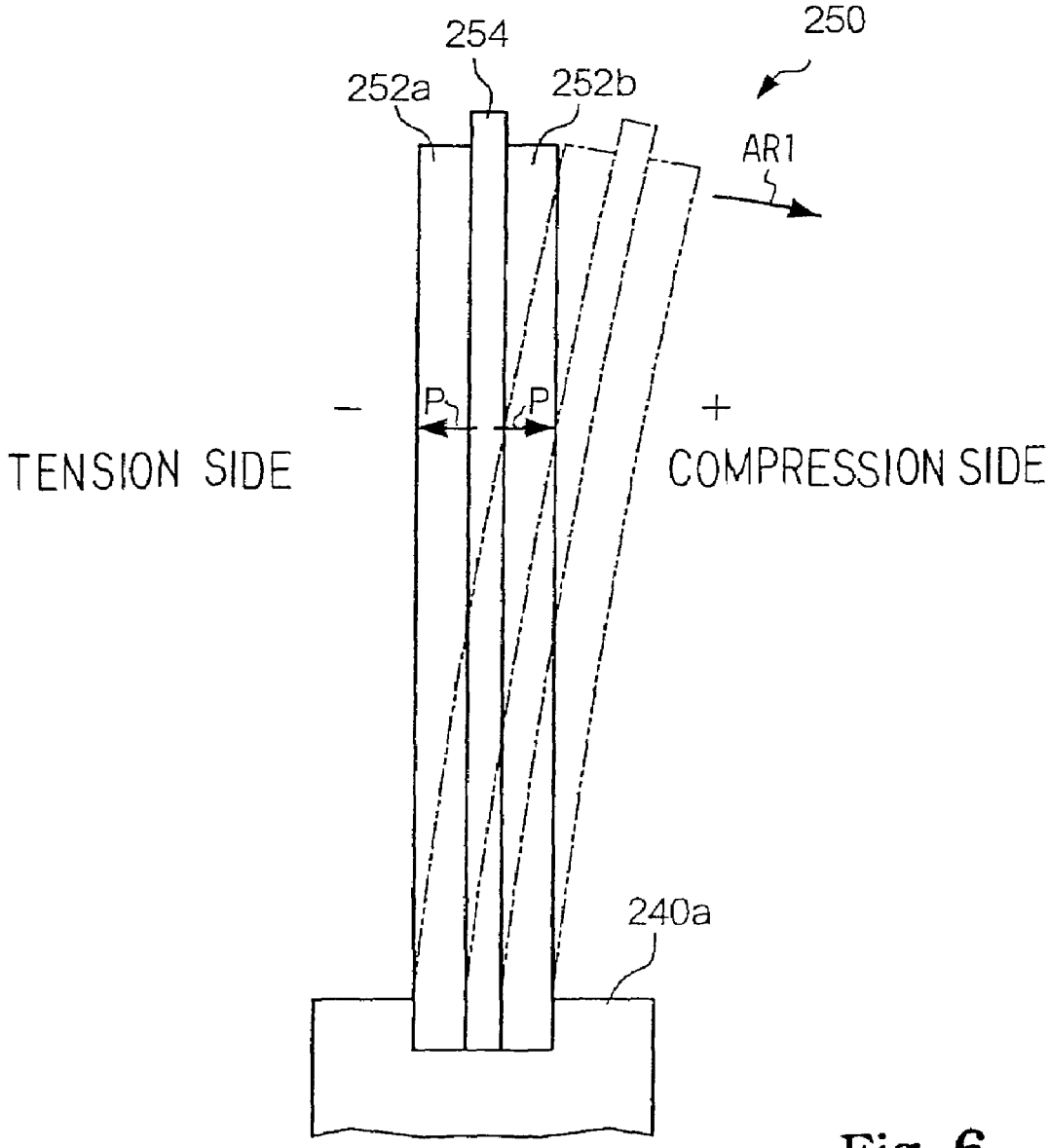
FIG. 6 is a front view showing the structure and behavior of the bimorph piezoelectric transducer.

Each of the bimorph piezoelectric transducers 250 includes a pair of piezoelectric elements 252*a*/252*b* and a base plate 254 as shown in FIG. 6. The base plate 254 is made of metal, and has elastically deformable. The base plate 254 is sandwiched between the piezoelectric elements 252*a* and 252*b*. In other words, the piezoelectric elements 252*a* and 252*b* are adhered to both major surfaces of the base plate 254, and the piezoelectric elements 252*a* have the polarization outwardly directed from the base plate 254 as indicated by arrows P. In other words, the piezoelectric element has the direction P of polarization opposite to that P of the other piezoelectric element. The directions of polarization P are in parallel to the major surface 210S (see FIG. 3). The lamination of the base plate 254 and piezoelectric elements 252*a*/252*b* is implanted in the sensor holder 240*a*/240*b*, and the piezoelectric elements 252*a*/252*b* are connected to the conductive lead 202. When the bimorph piezoelectric transducers 250 are installed in the bridge 200, the bimorph piezoelectric transducers 250 are symmetrically arranged with respect to the centerline O–O'.

Assuming now that the force is exerted on the bimorph piezoelectric transducer 250 in one of the directions P of the polarization, the bimorph piezoelectric transducer 250 is deformed in a direction indicated by an arrow AR1, and is deformed as indicated by dots-and-dash lines. The tensile force is exerted on the piezoelectric element 252*a*, and is elongated. On the other hand, the compressive force is exerted on the other piezoelectric element 252*b*, and is compressed. As a result, the piezoelectric element 252*b* has a positive potential level with respect to the other piezoelectric element 252*a*. If, on the other hand, the bimorph piezoelectric transducer 250 is deformed in the opposite direction, the piezoelectric element 252*a* has a positive potential level with respect to the other piezoelectric element 252*b*. The larger the strain, the larger the electromotive force. Thus, the bimorph piezoelectric transducers 250 can exactly convert the vibrations to the electric signal.

Figure 7:
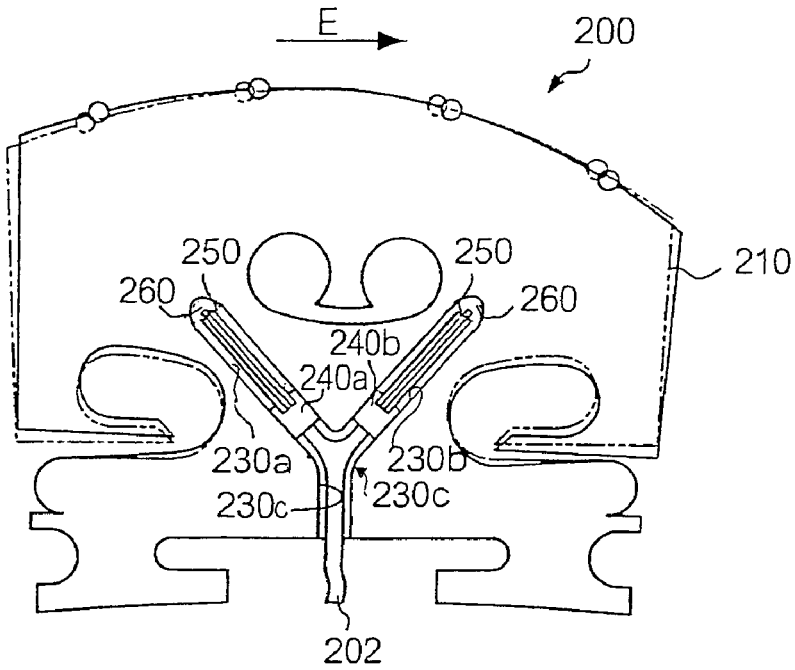
FIG. 7 is a front view showing the bridge propagating the vibrations to the bimorph piezoelectric transducers.
Figure 8:
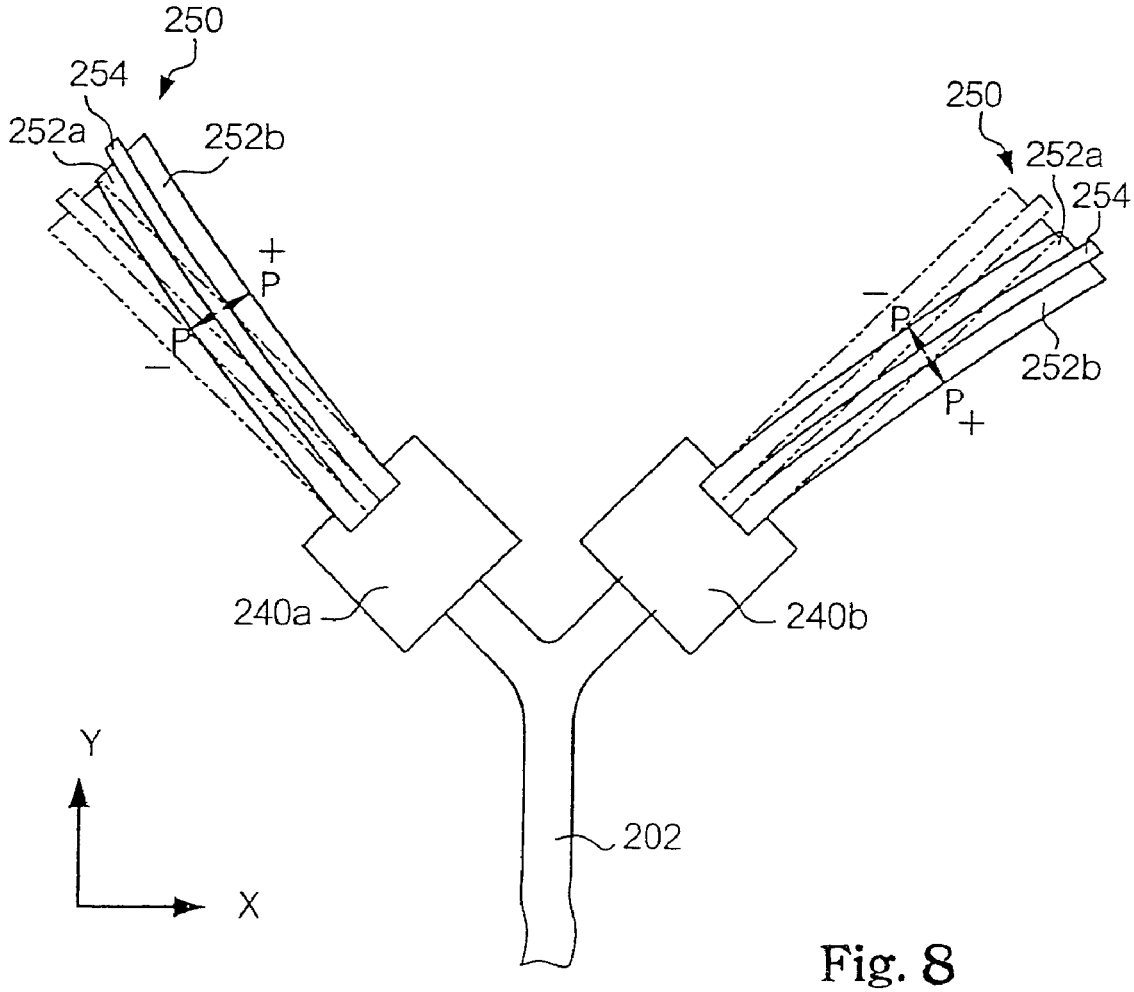
FIG. 8 is a front view showing the behavior of the bimorph piezoelectric transducers in the bridge.

While a player is bowing the acoustic violin 100, the strings 130 are vibrating, and the vibrations give rise to the vibrations of the bridge 200. The vibrating strings 130 are assumed to give rise to motion indicated by an arrow E (see FIG. 7). The bridge 200 is deformed as indicated by the real lines, and exerts the force on the piezoelectric elements 252*a*/252*b* (see FIG. 8) of the bimorph piezoelectric transducers 250. Both piezoelectric elements 252*a* are elongated as shown in FIG. 8, and both piezoelectric elements 252*b* are compressed. The vibrating strings 130 cause the bridge 200 to be oppositely deformed in the reverse direction of the arrow E at the next moment so that the both piezoelectric elements 252*a* and both piezoelectric elements 252*b* are compressed and elongated, respectively. Although the pairs of piezoelectric elements 252*a*/252*b* form the different bimorph piezoelectric transducers 250 symmetrically arranged in the bridge 200, the piezoelectric elements 252*a* are polarized in one direction, and the other piezoelectric elements 252*b* are polarized in the opposite direction. This results in a large amount of electric charge. In other words, the electric signal widely swings the potential level.

Figure 9:
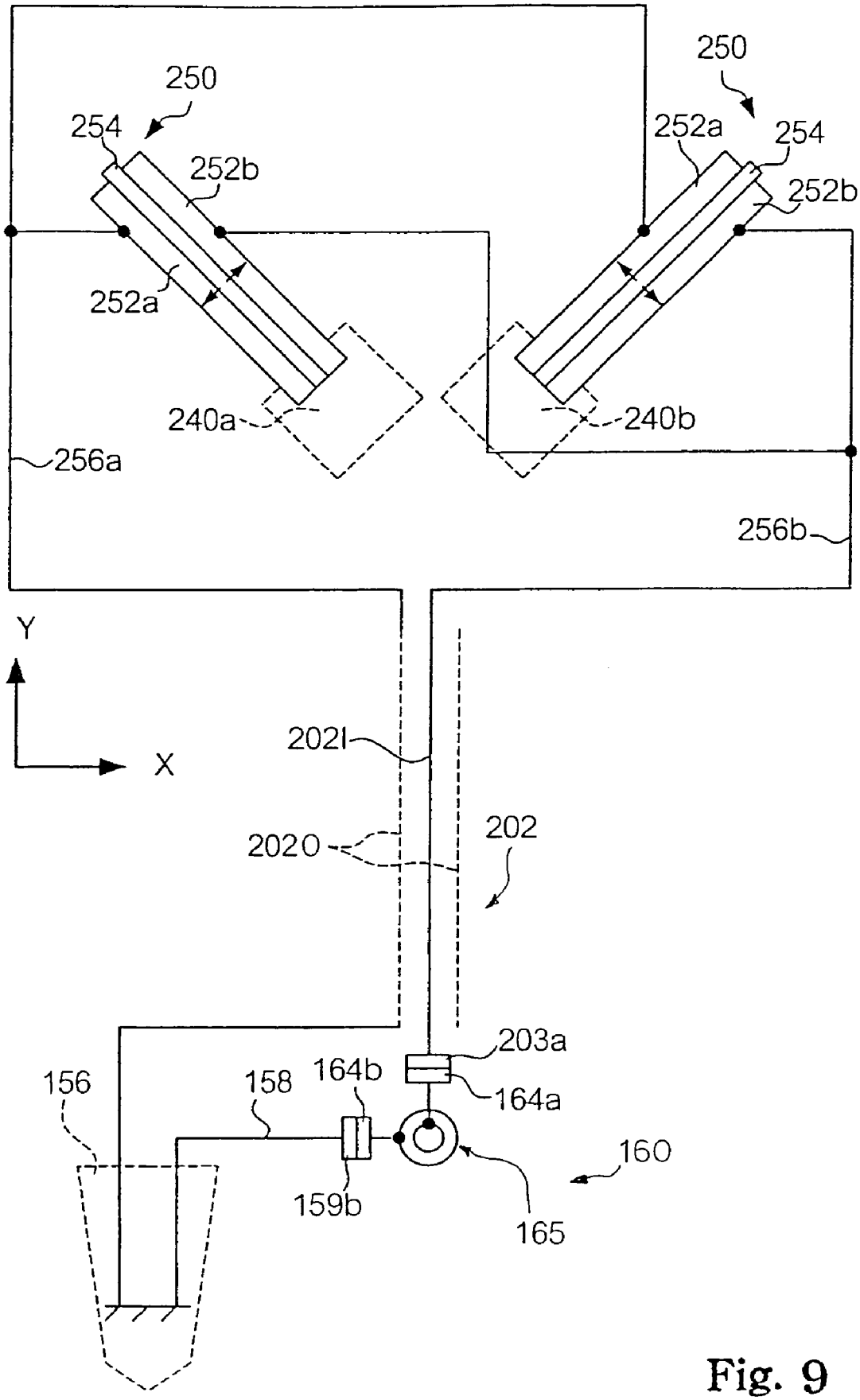
FIG. 9 is a circuit diagram showing electric connections between the bimorph piezoelectric transducers and a connector.

Turning to FIG. 9 of the drawings, the bimorph piezoelectric transducers 250 are connected to the connector 160 through the conductive lead 202. The piezoelectric elements 252*a* are connected through a conductive line 256*a* to each other, and the other piezoelectric elements 252*b* are connected through another conductive line 256*b* to each other.

The conductive line 256*a* is held in contact with the surfaces of the piezoelectric elements 252*a*, and the other conductive line 256*b* is also held in contact with the surfaces of the piezoelectric elements 252*b*. The conductive lines 256*a* and 256*b* form parts of the conductive lead 202 (see FIGS. 7 and 8).

The conductive lead 202 further includes an outer conductive strip 2020 and a conductive line 2021. The conductive line 256*b* is merged with the conductive line 2021, and the conductive line 256*a* is connected to the outer conductive strip 2020. The outer conductive strip 2020 is connected at the other end thereof to the conductive metal foil 156 so that the grand potential is applied to the piezoelectric elements 252*a* through the outer conductive strip 2020 and conductive line 256*a*. On the other hand, the conductive line 2021 is terminated at a contact 203*a*, which is electrically connected to a conductive socket 164*a* of the connector 160. The conductive socket 164*a* is connected through the connector 160 and conductive cable 202*a* to the sound unit 180. Thus, the piezoelectric elements 252*b* are electrically connected to the sound unit 180.

The connector 160 further includes a contact 164*b*, which is electrically isolated from the conductive socket 164*a*, and the contact 164*b* is held in contact with a terminal 159*b*. The terminal 159*b* is fixed to a conductive line 158, which in tern is connected to the conductive metal foil 156. As described hereinbefore, the strings 130 are electrically connected to the conductive metal foil 156. A human player selectively presses the strings 130 to the fingerboard 140 with his or her fingers. This means that the strings 130 and conductive metal foil 156 are equal in potential level to the human player, i.e., ground level. Thus, the ground level is applied to the piezoelectric elements 252*a* through the outer conductive strip 2020 and conductive line 256*a* and to the sound unit 180 through the conductive line 158, connector 160 and conductive cable 202*a*. Since the ground level is stable, the outer conductive strip 2020 thus grounded through the conductive metal foil 156 is effective against the noise ridden on the electric signal.

Turning back to FIG. 2 of the drawings, the electrical connection between the bimorph piezoelectric transducers 250 and the connector 160 is illustrated. The connector 160 serves as an interface and a coupling device. The connector 160 has a clamp 162, which in tern has a turn buckle 161. The clamp 162 further has a pair of pads 163, and the distance between the pads 163 is changeable. When a player prepares the electric acoustic stringed musical instrument for his or her performance, he or she brings the pads 163 into contact with the soundboard 112 and the reverse board, and pinches the body 110 between the pads 163. Then, the connector 160 and, accordingly, one end of the conductive cable 202*a* are physically coupled to the body 110. The connector 160 further has a pair of terminals 165, which is electrically connected to the cable 202*a*. The terminals 165 are further connected to the conductive socket 164*a* and contact 164*b*, respectively. The contact 203*a* and terminal 159*b* are connectable to and separable from the conductive socket 164*a* and terminal 159*b*. For this reason, the connector 160 is firstly connected to the body 110, and, thereafter, the conductive cable 202 and grand line 158 are electrically coupled to the connector 160.

As described hereinbefore, the conductive socket 164*a* is electrically connected through the contact 203*a* to the conductive line 2021, and the contact 164*b* is electrically connected through the terminal 159*b* and conductive line 158 to the conductive metal foil 156. For this reason, the electric signal, which is representative of the vibrations, is supplied through the connector 160 and conductive cable 202*a* to the sound unit 180.

The conductive cable 202 is a coaxial cable so that the conductive line 2021 is shielded with the outer conductive strip 2020. The outer conductive strip 2020 is fixed at the other end thereof to the conductive metal foil 156 by means of a piece of solder 157, and the conductive line 158 is also fixed at the other end thereof to the conductive metal foil 156 by means of a piece of solder 159.

The sound unit 180 includes a control amplifier and a power amplifier. The volume and balance are adjusted through the control amplifier, and effects are selectively imparted to the electric tones through the control amplifier. The tone radiator 182 is driven by means of the power amplifier for radiating the electric tones. In this instance, the tone radiator 182 is implemented by loud speakers. The control amplifier, power amplifier and loud speakers are well known to persons skilled in the art, and no further description is hereinafter incorporated for the sake of simplicity.

Description is hereinafter made on the behavior of the electric acoustic stringed musical instrument. A player is assumed to wish to perform a piece of music on the electric acoustic stringed musical instrument. The player attaches the connector 160 to the body 110, and electrically connects the pickup unit 170 through the connector 160 to the sound unit 180. The player adjusts the volume and balance through the control amplifier.

The player starts to bow the strings 130, and gives rise to vibrations of the strings 130 at certain frequencies corresponding to the pitches of the electric tones to be produced. The vibrating strings 130 exert the force on the bridge 200 in the direction E at a certain moment (see FIG. 7). Then, the bridge 200 is deformed as indicated by the real lines, and the stress makes the bimorph piezoelectric transducers 250 bent as indicated by the real lines in FIG. 8. The piezoelectric elements 252*a* are elongated, and the other piezoelectric elements 252*b* are compressed. As a result, the electric charge is produced on the surfaces of the piezoelectric elements 252*a*/252*b*. The electric charge on the surface of the piezoelectric element 252*a* in the branch portion 230*a* is identical in polarity with the electric charge on the surface of the piezoelectric element 252*a* in the other branch portion 230*b*, but is opposite in polarity to the electric charge on the surfaces of the piezoelectric elements 252*b*. When the bridge 200 is deformed in the direction E, the electric charge makes the potential level on the surfaces of the piezoelectric elements 252*b* positive with respect to the potential level on the surfaces of the other piezoelectric elements 252*a*. Since the piezoelectric elements 252*b* are connected in parallel to the conductive line 256*b*, the electric signal widely swings the potential level to the positive side without any cancellation, and is supplied through the connector 160 to the sound unit 180.

When the force is removed from the bridge 200, the bridge 200 returns to the initial shape, and the bimorph piezoelectric transducers 250 return to the neutral state. Then, the potential difference is reduced to zero. On the other hand, when the force is exerted on the bridge 200 in the direction opposite to the arrow E, the bridge 200 is deformed toward the opposite side, and electric charge makes the potential level on the surfaces of the piezoelectric elements 252*b* negative with respect to the potential level on the surfaces of the other piezoelectric elements 252*a*. As a result, the electric signal swings the potential level to the negative side. Thus, the pickup unit 170 converts the vibrations of the strings 130 to the electric signal, and the electric tones are produced from the electric signal through the sound unit 180 and tone radiator 182.

As will be appreciated from the foregoing description, the piezoelectric elements 252*a*/252*b* are loosely received in the bifurcated groove 230, which is formed in the bridge 200, and the gaps between the bridge 200 and the piezoelectric elements 252*a*/252*b* are filled with the filler 260. The following advantages are resulted from those primary features.

First, the bimorph piezoelectric transducers 250 are free from the downward composite force of the tension exerted on the bridge 250 by the strings 130. Only the stress due to the deformation of the bridge 250 is exerted on the bimorph piezoelectric transducers 250 so that the bimorph piezoelectric transducers 250 produce the electric signal exactly representing the vibrations of the strings 130.

Second, the bimorph piezoelectric transducers 250 do not change the height of the bridge 250. The strings 130 are directly in contact with the arc surface 200*a*, and the feet 212 are held in contact with the soundboard 112. The bridge 250 is attached to the body 110 as similar to that of a standard violin. For this reason, players easily optimize the height of the strings 130 as usual.

The electric acoustic stringed musical instrument shown in FIGS. 1 to 9 further has secondary features. One of the secondary features is the symmetrical arrangement of the bimorph piezoelectric transducers 250. In order to arrange the bimorph piezoelectric transducers 250, symmetrically, the branch portions 230*a* and 230*b* are symmetrically formed in the bridge 200 with respect to the centerline O–O'. The symmetrical arrangement is desirable for the strings 130, because the pickup unit 170 impartially converts the vibrations of the four strings 130 to the electric signal.

Another secondary feature is the plasticity of the filler 260. While a player is bowing, the strings 130 exert the force through the bridge 250 on the filler 260, and the force makes the filler 260 plastically deformed. This means that the elastic strain energy is ignoreable. For this reason, when the force is removed from the filler 260, the filler 260 neither has the elastic strain energy to be released, nor exerts any stress on the piezoelectric elements 252*a*/252*b*. Thus, the filler 260 is faithful in the transmission of the force from the bridge 250 to the piezoelectric elements 252*a*/252*b*, and does not behave as an origin of noise on the electric signal.

Yet another secondary feature is the position where the bimorph piezoelectric transducers 250 are embedded in the bridge 200. If piezoelectric transducers were respectively provided beneath the strings 130, the vibrations would be converted to electric signals more exactly than those applied to the bridge 200. However, these piezoelectric transducers are too far from the soundboard to detect the resonant vibrations of the body. For this reason, the electric tones are less analogous to the acoustic tones. On the other hand, the bimorph piezoelectric transducers 250 are not so far from the soundboard 112 that the resonant vibrations can reach the bimorph piezoelectric transducers 250. Not only the original vibrations of the strings 130 but also the resonant vibrations of the body 110 are transferred to the bimorph piezoelectric transducers 250, and are converted to the electric signal. The electric signal represents both original and resonant vibrations so that the electric tones are close to the acoustic tones.

Still another secondary feature is the bimorph piezoelectric transducers 250 shared among the strings 130. In other words, the number of the bimorph piezoelectric transducers 250 is less than the number of the strings 130. This results in reduction of the production cost.

Yet another secondary feature is the groove 230, which comes out on the major surface 210*s* of the bridge 200. If pressure sensors were provided on the side surfaces of the bridge 200 such as the curved surface defining the hollow spaces 220*a* and 220*b*, the pressure sensors would be liable to be separated from the side surfaces. This is because of the fact that the side surfaces are violently shaken. On the other hand, the bimorph piezoelectric sensors 250 are received in the branch portions 230*a* and 230*b*, and the holders 240*a*/240*b* are adhered to the bridge 200. For this reason, the bimorph piezoelectric transducers 250 withstand the vibrations of the bridge 200, and are durable.

Second Embodiment

Figure 10:
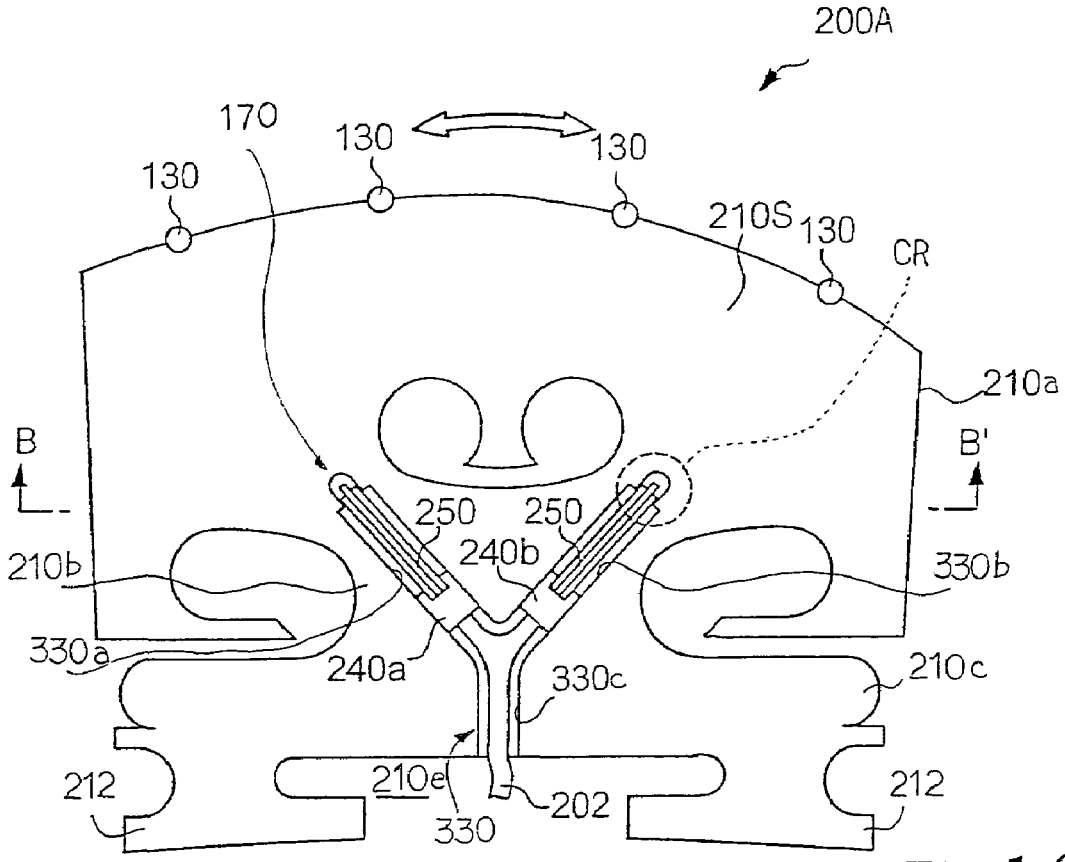
FIG. 10 is a front view showing the shape of a bridge incorporated in an acoustic stringed musical instrument of another electric acoustic stringed musical instrument according to the present invention.
Figure 13:
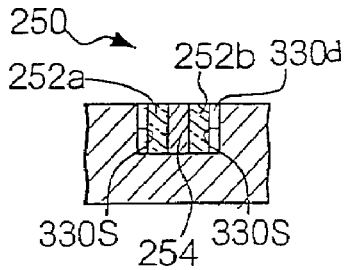
FIG. 13 is a cross sectional view taken along line C–C' of FIG. 12 and showing the bimorph piezoelectric transducer.

Turning to FIGS. 10 and 13, another electric acoustic stringed musical instrument also comprises an acoustic stringed musical instrument and an electric system, and the acoustic stringed musical instrument is equipped with a bridge 200A. The other component parts of the acoustic stringed musical instrument and electric system are similar to those of the first embodiment, and are not described hereinafter for avoiding repetition.

The bridge 200A has a contour like that of the bridge 200, and a difference between the bridges 200 and 200A is directed to a bifurcated groove 330. Portions and other component parts of the acoustic stringed musical instrument are labeled with the references designating the corresponding portions and component parts shown in FIGS. 1 to 9 without detailed description.

Figure 12:
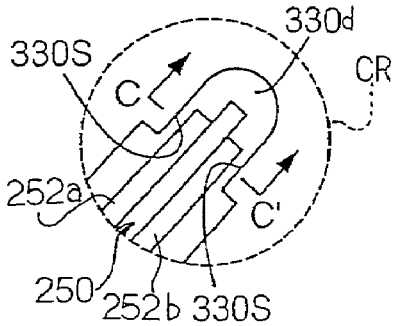
FIG. 12 is a front view showing a part of the bimorph piezoelectric transducer encircled in broken line CR of FIG. 10 at a large scale.
Figure 11:
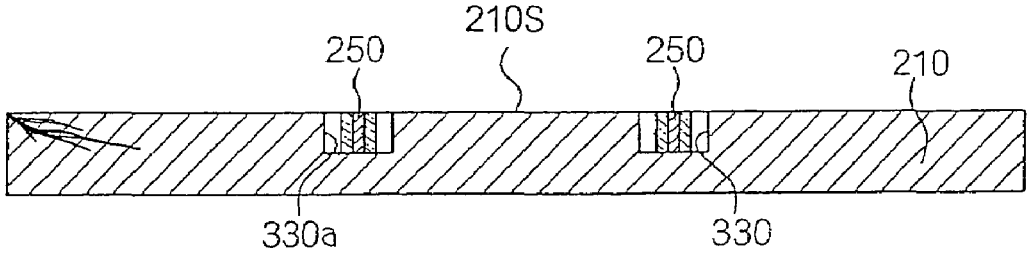
FIG. 11 is a cross sectional view taken along line B–B' of FIG. 10, and showing bimorph piezoelectric transducers embedded in the bridge.

The bifurcated groove 330 has a pair of branch portions 330*a*/330*b* and a trunk portion 330*c*. The trunk portion 330*c* upwardly extends from the gap 210*e* through the bifurcated portion 210*c*, and branches at the boundary between the bifurcated portion 210*c* and the constricted portion 210*b*. The branch portions 330*a*/330*b* upwardly obliquely project through the constricted portion 210*b* into the arched portion 210*a*, and are symmetrically arranged with respect to the centerline of the bridge 200A. Most of the branch portion 220*a*/330*b* is as wide as the sensor holder 240*a*/240*b*, and the sensor holders 240*a*/240*b* are snugly received in the branch portions 330*a*/330*b*. The sensor holders 240*a*/240*b* are adhered to the inner surfaces of the bridge 200A. The upper zones 330*d* of the branch portions 330*a*/330*b* are reduced in width, and the width of the upper zones 330*d* is slightly larger in value than the thickness of the bimorph piezoelectric transducers 250 as shown in FIG. 12. For this reason, when the bimorph piezoelectric transducers 250 are received in the branch portions 330*a*/330*b*, extremely narrow gaps take place between the inner surfaces 330*s* and the piezoelectric elements 252*a*/252*b*. However, the gaps are not filled with any filler. For this reason, most of the piezoelectric elements 252*a*/252*b* are widely spaced from the inner surfaces 330*s*, and the remaining piezoelectric elements 252*a*/252*b*, which are in the upper zone 330*d*, are as close to the inner surfaces 330*s* as possible. For this reason, when the bridge 200A is deformed, the inner surfaces 330*s* push the upper portions of the piezoelectric elements 252*a*/252*b*, and bend the piezoelectric elements 252*a*/252*b*. The piezoelectric elements 252*a* and piezoelectric elements 252*b* are alternately elongated and compressed so that the electric charge is generated in the piezoelectric elements 252*a*/252*b*.

The electric acoustic stringed musical instrument implementing the second embodiment achieves all the advantages of the first embodiment. Moreover, the electric acoustic stringed musical instrument of the second embodiment is advantages in that the bridge 200A is free from the aged deterioration of the filler 260.

Third Embodiment

Figure 14:
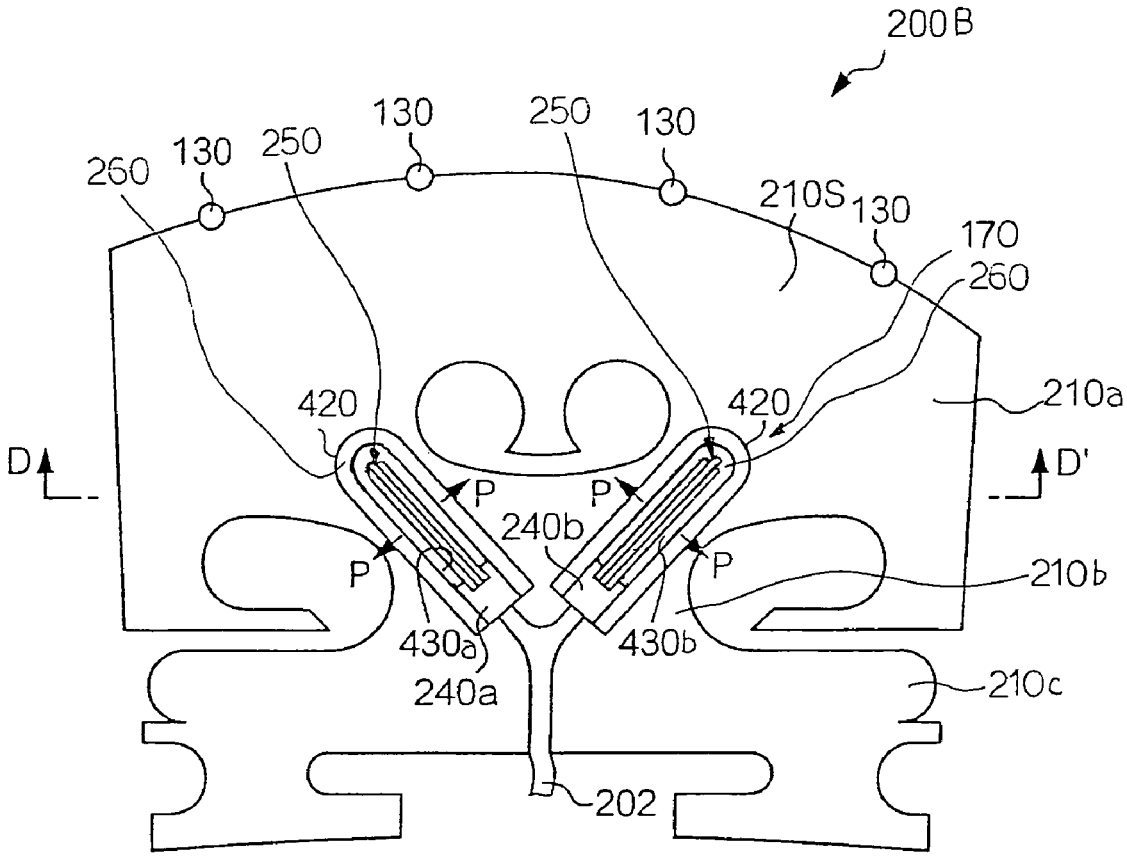
FIG. 14 is a front view showing the shape of a bridge incorporated in an acoustic stringed musical instrument of yet another electric acoustic stringed musical instrument according to the present invention.
Figure 15:
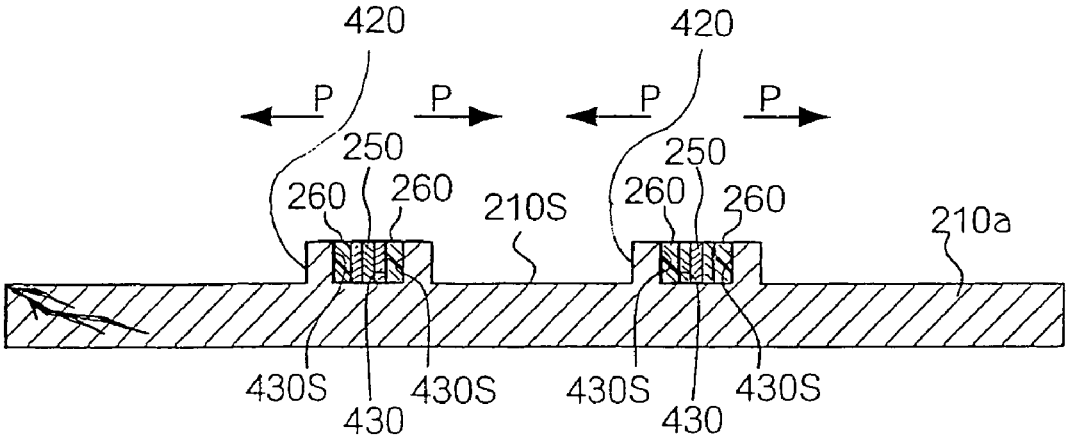
FIG. 15 is a cross sectional view taken along line D–D' of FIG. 14, and showing bimorph piezoelectric transducers embedded in the bridge.

Turning to FIGS. 14 and 15, yet another electric acoustic stringed musical instrument also largely comprises an acoustic stringed musical instrument and an electric system. The electric system is same as the electric system 90, and the acoustic stringed musical instrument is similar to the acoustic stringed musical instrument 80 except a bridge 200B. For this reason, description is hereinafter focused on the bridge 200B.

The bridge 200B is shown in FIGS. 14 and 15. The difference between the bridges 200 and 200B is directed to a pair of lobes 420, and the bimorph piezoelectric transducers 250 are embedded in the lobes 420, respectively. The lobes 420 frontward project from the major surface 210S of the bridge 200B, and are symmetrically arranged. However, the lobes 420 are independent of each other.

Grooves 430*a*/430*b* are respectively formed in the lobes 420, and the bimorph piezoelectric transducers 250 are respectively received in the grooves 430*a*/430*b*. The grooves 430*a*/430*b* are symmetrically arranged with respect to the centerline of the bridge 200B, and, accordingly, the bimorph piezoelectric transducers 250 are also symmetrically arranged. The grooves 430*a*/430*b* are constant in width, and are not narrowed. The sensor holders 240*a*/240*b* are snugly received in the grooves 430*a*/430*b*, and the pairs of piezoelectric elements 252*a*/252*b* project from the sensor holders 240*a*/240*b*, respectively. Gaps take place between the inner surfaces 430*s* and the piezoelectric elements 252*a*/252*b*, and are filled with filler 260. In this instance, the filler 260 is made of the plastic material. The direction of polarization in the piezoelectric elements 252*a*/252*b* is labeled with "P" in FIG. 14.

The electric acoustic stringed musical instrument implementing the third embodiment also achieves all the advantages of the first embodiment.

Fourth Embodiment

Still another electric acoustic stringed musical instrument embodying the present invention also largely comprises an acoustic stringed musical instrument and an electric system 90A. The acoustic stringed musical instrument is similar to that of the first, second or third embodiment, and is not described for the sake of simplicity.

Figure 16:
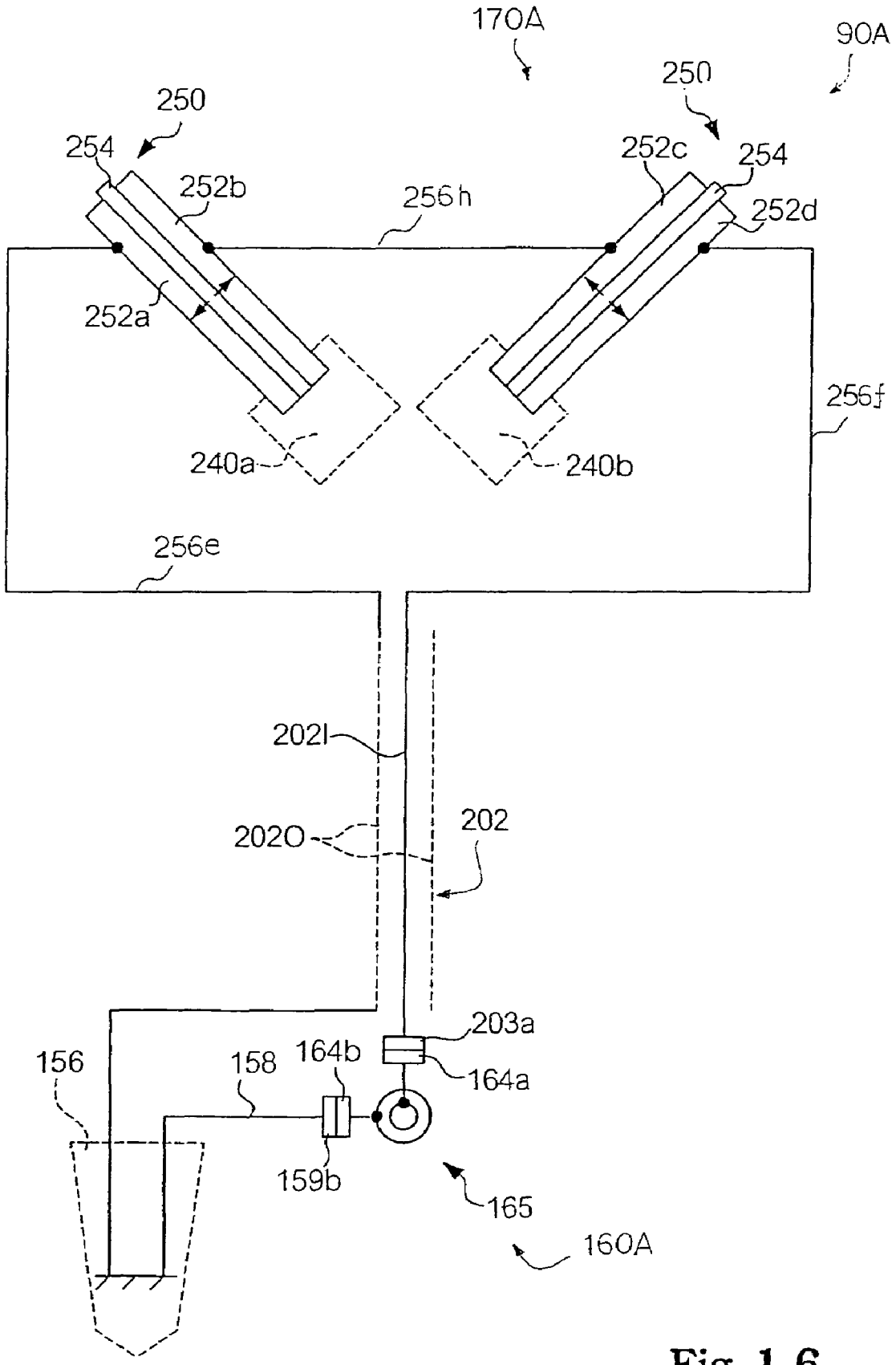
FIG. 16 is a circuit diagram showing the circuit configuration of another electric system incorporated in still another electric acoustic stringed musical instrument according to the present invention.

The difference between the electric system 90 and the electric system 90A is directed to the serial connection between the bimorph piezoelectric transducers 250 so that description is made on the connection between the pickup unit 170A and the connector 160A with reference to FIG. 16.

The circuit components of the electric system 90A are similar to those of the electric system 90, and, for this reason, are labeled with references designating the corresponding circuit components of the electric system 90. Nevertheless, the piezoelectric elements of the right bimorph piezoelectric transducer 250 are labeled with references "252*c*" and "252*d*" differently from those of the left bimorph piezoelectric transducer 250. The piezoelectric elements 252*a*/252*c* are identical in polarity with each other, and are opposite in polarity to the piezoelectric elements 252*b*/252*d*.

The bimorph piezoelectric transducers 250 are connected in series between the outer conductive strip 2020 and the conductive line 2021 both forming the parts of the conductive cable 202. The outer conductive strip 2020 is connected through a conductive line 256*e*to the piezoelectric element 252*a* of the left bimorph piezoelectric transducer 250, and the conductive line 2021 is connected through a conductive line 256*f*to the piezoelectric element 252*d*. A conductive line 256*h* is connected between the piezoelectric element 252*b* and the piezoelectric element 252*c* so that the bimorph piezoelectric transducers 250 are connected in series between the outer conductive strip 2020 and the conductive line 2021. For this reason, the electromotive force of the left bimorph piezoelectric transducer 250 is not canceled with the electromotive force of the right bimorph piezoelectric transducer 250. The potential difference between the piezoelectric elements 252*a* and 252*d* is taken out as the electric signal.

The electric acoustic stringed musical instrument implementing the fourth embodiment achieves all the advantages of the first embodiment.

Other Embodiments

Another modification of the electric system 90 further includes a microphone. The other features are similar to those of the above-described embodiments, and no further description is hereinafter incorporated for the sake of simplicity.

In this instance, the microphone is connected to the sound unit 180 in parallel to the pickup unit 170. The acoustic tones, which are radiated from the body 110, are converted to another electric signal, and the electric signal is supplied to the sound unit 180. The player selects one of the electric signals, and the electric tones are produced from the selected electric signal. The acoustic tones, which are picked up by means of the microphone, contain the echo and reverberation in the environment such as, for example, a concert hall. On the other hand, the vibrations of the bridge 200 are free from those environmental influences, and, for this reason, various effects are artificially imparted to the electric tones. In case where the electric acoustic musical instrument is equipped with the modification of the electric system, the player has an option between the microphone and the pickup unit 170. Thus, the first modification of the electric system makes the artificial expression through the electric acoustic stringed musical instrument rich.

Yet another modification of the electric system 90 has a frequency compensation capability. When a trainee practices the bowing on an acoustic stringed musical instrument, he or she sometimes attach a mute to the acoustic stringed musical instrument, and reduces the loudness of the acoustic tones so as not to disturb the neighborhood. However, the mute changes the frequency spectrum. If the electric tones are produced from the electric signal without any frequency compensation, the listeners feel the electric tones strange.

The difference between the frequency spectrum measured without the mute and the frequency spectrum measured with the mute is experimentally determined, and a frequency compensating circuit is provided in the sound unit 180. While a player is bowing on the strings 130 without the mute, the electric signal bypasses the frequency compensating circuit, and the any frequency compensation is not carried out. However, while the player is bowing after attachment of the mute to the acoustic stringed musical instrument, the electric signal is processed through the frequency compensating circuit, and the missing frequency components are added to the electric signal. The electric signal may be led to a headphone, and is converted to the electric tones through the headphone. Thus, the player can practice the bowing without disturbance to the neighborhood.

Although particular embodiments of the present invention have been shown and described, it will be apparent to those skilled in the art that various changes and modifications may be made without departing from the spirit and scope of the present invention.

The sound unit 180 and tone radiator 182 may be built in the acoustic stringed musical instrument. In this instance, the portability is enhanced. However, the quality of electric tones may be poorer than those radiated from the separate-type sound unit/loud speakers 180/182. The loud speakers do not set any limit to the technical scope of the present invention. The soundboard 112 may be directly driven for vibrations.

The bimorph piezoelectric transducers 250 do not set any limit to the technical scope of the present invention. Monomorph piezoelectric transducers are available for the pickup unit 90*a*.

The mono-morph/bimorph piezoelectric transducers do not set any limit to the technical scope of the present invention. Any sort of transducers is available for the electric acoustic stringed musical instrument in so far as the transducers can convert the force/pressure/displacement into an electric signal or an optical signal. Strain gauges are examples of the other sorts of transducers available for the electric acoustic stringed musical instruments according to the present invention.

The bifurcated groove 230 does not set any limit to the technical scope of the present invention. Two hollow spaces may be formed in the bridge 200 independently of each other. In this instance, the bimorph piezoelectric transducers are respectively embedded in the hollow spaces, and the gap is filled with the filler. Otherwise, the hollow spaces are partially constricted so that the inner surfaces directly push the bimorph piezoelectric transducers.

The configurations of the groove or grooves do not set any limit to the technical scope of the present invention. In the embodiments described hereinbefore, the flat inner surfaces are confronted with the piezoelectric elements 252*a*/252*b*. However, a groove or grooves may be partially defined by curved surfaces. Although the bifurcated groove 230/330 and the pair of grooves 430*a*/430*b* have bottoms, a bifurcated groove or grooves may come out on both major surfaces.

The pair of piezoelectric transducers does not set any limit to the technical scope of the present invention. Only one piezoelectric transducer may be embedded in the bridge 200, or more than two piezoelectric transducers may be embedded in the bridge 200.

The shape of the bridge does not set any limit to the technical scope of the present invention. Various shapes of bridges are known to persons skilled in the art, and the bridge 200/200A/200B may be replaced with any one of those bridges.

The acoustic violin does not set any limit to the technical scope of the present invention. The acoustic violin is replaceable with another member of the violin family such as a viola, a cello or a double bass. The present invention may be applied to a plucked stringed musical instrument such as, for example, guitars.

The sound unit 180 and tone radiator 182 may be eliminated from the electric acoustic stringed musical instrument according to the present invention. In this instance, the pickup unit and connector constitute the electric system, and the electric acoustic stringed musical instrument is sold separately from the sound unit 180 and tone radiator 182.

The oil clay does not set any limit to the technical scope of the present invention. The oil clay may be replaced with another sort of plastic clay, which is mixture between clay and viscous substance.

The four strings 130 do not set any limit to the technical scope of the present invention. Only one string may stretched over a body. More than four strings may be stretched over another body.

Claim languages are correlated with the component parts of the above-described embodiments as follows. Elements "body", "upper surface", "neck", "at least one string", "bridge", "inner surface defining a hollow space", "pickup unit" and "output terminal" are corresponding to the body 110, upper surface of the soundboard 112, combination of neck 120 and fingerboard 140, strings 130, bridges 200/200A/200B, inner surfaces 230*s*/330*s*/430*s* defining the bifurcated grooves 230/330 and pair of grooves 430*a*/430*b*, pickup units 170/170A and connectors 160/160A, respectively. The piezoelectric elements 252*a*/252*b* and 252*a*/252*b*/252*c*/252*d* serve as an element "sensing portion". The branch portions 230*a*/230*b*, 330*a*/330*b* and pair of grooves 430*a*/430*b* are corresponding to "hollow sub-spaces". The groove or grooves are examples of "at least one hollow space".

What is claimed is:

1. An electric acoustic stringed musical instrument comprising:

an acoustic stringed musical instrument including a body having an upper surface, a neck projecting from one end of said body, at least one string stretched between a leading end of said neck and the other end of said body, and a bridge provided between said upper surface of said body and said at least one string so as to give tension to said at least one string, deformable in the presence of vibrations transmitted from said at least one string and having an inner surface defining at least one hollow space, said bridge being further formed with a first inlet and a second inlet disposed between said at least one hollow space and both side portions of said bridge and making said both side portions spaced from a lower portion of said bridge held in contact with said body and a through-hole disposed between said at least one hollow space and an upper portion of said bridge held in contact with said at least one string, whereby said first and second inlets and said through-hole permit said at least one hollow-space to be widely deformed in the presence of said vibrations and an electric system including a pickup unit received in said at least one hollow space and applied with force due to said vibrations of said at least one string through said inner surface, and an output terminal electrically connected to said pickup unit for outputting said signal.

2. The electric acoustic stringed musical instrument as set forth in claim 1, in which said pickup unit has a sensing portion sensitive to said vibrations and loosely received in said hollow space, and a gap between said sensing portion and said inner surface is filled with filler so that said vibrations are transmitted from said inner surface through said filler to said sensing portion.

3. The electric acoustic stringed musical instrument as set forth in claim 2, in which said filler is made of material exhibiting plasticity when said force is exerted thereon.

4. The electric acoustic stringed musical instrument as set forth in claim 3, in which said material is oil clay.

5. The electric acoustic stringed musical instrument as set forth in claim 2, in which said pickup unit has plural transducers, and said hollow space has plural hollow sub-spaces where said plural transducers are respectively received.

6. The electric acoustic stringed musical instrument as set forth in claim 5, in which said plural hollow sub-spaces are arranged symmetrically with respect to a centerline of said bridge so that said plural transducers are also symmetrically arranged in said bridge.

7. The electric acoustic stringed musical instrument as set forth in claim 5, in which said plural transducers are connected in such a manner that output signals of said plural transducers are output from said output terminal without any cancellation between said output signals.

8. The electric acoustic stringed musical instrument as set forth in claim 2, in which said sensing portion is formed by at least one bimorph element.

9. The electric acoustic stringed musical instrument as set forth in claim 8, in which said at least one bimorph element has a pair of piezoelectric elements.

10. The electric acoustic stringed musical instrument as set forth in claim 1, in which said pickup unit has a sensing portion sensitive to said vibrations, and said inner surface is partially narrowed so as to directly exert said force on said sensing portion.

11. The electric acoustic stringed musical instrument as set forth in claim 10, in which said inner space forms a step for dividing said hollow space into a wide portion and a narrow portion, and said sensing portion extends through said wide portion into said narrow portion so that said step exerts said force on a leading end of said sensing portion.

12. The electric acoustic stringed musical instrument as set forth in claim 10, in which said pickup unit has plural transducers, and said hollow space has plural hollow sub-spaces where said plural transducers are respectively received.

13. The electric acoustic stringed musical instrument as set forth in claim 12, in which said plural hollow sub-spaces are arranged symmetrically with respect to a centerline of said bridge so that said plural transducers are also symmetrically arranged in said bridge.

14. The electric acoustic stringed musical instrument as set forth in claim 12, in which said plural transducers are connected in such a manner that output signals of said plural transducers are output from said output terminal without any cancellation between said output signals.

15. The electric acoustic stringed musical instrument as set forth in claim 10, in which said sensing portion is formed by at least one bimorph element.

16. The electric acoustic stringed musical instrument as set forth in claim 15, in which said at least one bimorph element has a pair of piezoelectric elements.

17. The electric acoustic stringed musical instrument as set forth in claim 1, in which said electric system further includes a tone radiator converting said signal to electric tones, and a sound unit for driving said tone radiator with said signal.

18. The electric acoustic stringed musical instrument as set forth in claim 1, in which said acoustic stringed musical instrument further has a bow so that a player gives rise to said vibrations of said strings through bowing.

19. The electric acoustic stringed musical instrument as set forth in claim 18, in which said body has a contour like an acoustic violin.

20. A bridge provided between a body and at least one string both incorporated in an electric acoustic stringed musical instrument for imparting tension to said at least one string, said bridge comprising a plate member deformable in the presence of vibrations transmitted from said at least one string and having an inner surface defining at least one hollow space where a pickup unit is received in such a manner that force is exerted on said pickup unit by said inner surface due to said vibrations, said plate member being formed with a first cut-out and a second cut-out disposed between said at least one hollow space and both side portions of said plate member and making said both side portions spaced from a lower portion of said bridge held in contact with said body and a through-hole disposed between said at least one hollow space and an upper portion of said plate member held in contact with said at least one string, whereby said first and second cut-outs and said through-hole permit said pickup unit in said at least one hollow-space to be widely deformed in the presence of said vibrations.

21. The bridge as set forth in claim 20, further comprising filler inserted into a gap between said inner surface and said pickup unit for transmitting said force to said pickup unit.

22. The bridge as set forth in claim 21, in which said filler is made of material exhibiting plasticity in the presence of said force applied thereto.

23. The bridge as set forth in claim 20, in which said inner surface makes said hollow space partially narrowed so that said force is directly exerted on said pickup unit therefrom.

24. The bridge as set forth in claim 20, in which said hollow space has plural hollow sub-spaces respectively assigned to plural transducers forming parts of said pickup unit.

25. The bridge as set forth in claim 24, in which said hollow sub-spaces are symmetrically arranged with respect to a centerline of said bridge.

26. A bridge provided between a body of a stringed musical instrument and plural strings and deformable in the presence of vibrations of at least one of said plural strings, said bridge comprising:

a body member formed with a first cut-out and a second cut-out respectively formed in side portions of said body member and penetrating said body member in a direction of the thickness of said body member, a third cut-out formed in a center portion of said body member and between said side portions and penetrating said body member in said direction of said thickness, a first dent defined by a first surface extending between said first cut-out and said third cut-out and a second dent defined by a second surface extending between said second cut-out and said third cut-out; and a pickup unit provided inside of said first and second dents in such a manner as to be spaced from a part of said first surface serving as a first inner wall defining said second dent, and detecting the deformation of said bridge.

27. The bridge as set forth in claim 26, in which said first dent and said second dent are respectively formed by a first branch of a groove and a second branch of said groove partially defined by said first and second inner walls.

* * * * *